United States Patent [19]

Krakow

[11] 4,196,953

[45] Apr. 8, 1980

[54] DARKROOM MODULE

[76] Inventor: Kalman I. Krakow, 780 Querbes Ave. Apt. 101, Outremont, Quebec, Canada

[21] Appl. No.: 714,584

[22] Filed: Aug. 16, 1976

[30] Foreign Application Priority Data

Aug. 21, 1976 [CA] Canada ..... 233908

[51] Int. Cl.[2] ..... A47B 96/00

[52] U.S. Cl. ..... 312/250; 312/201; 312/209; 312/291; 312/296

[58] Field of Search ..... 312/250, 249, 201, 209, 312/101, 237, 291, 286; 52/173 DS

[56] References Cited

U.S. PATENT DOCUMENTS

| | | | |
|---|---|---|---|
| 1,326,940 | 1/1920 | Lemily | 312/291 |
| 1,812,890 | 7/1931 | McWhorter | 312/250 |
| 2,841,410 | 7/1958 | Kessler, Jr. et al. | 312/250 |
| 2,874,971 | 2/1959 | Devery | 312/249 |
| 3,284,148 | 11/1966 | Ramniceanu | 312/209 |
| 3,368,857 | 2/1968 | Harding | 312/250 |
| 3,459,463 | 8/1969 | Nacht | 312/296 |
| 3,547,505 | 7/1969 | Ott et al. | 312/209 |
| 3,584,927 | 6/1971 | Ott | 312/209 |
| 4,026,616 | 5/1977 | Kuehl | 312/201 |

FOREIGN PATENT DOCUMENTS

| | | | |
|---|---|---|---|
| 1284593 | 12/1968 | Fed. Rep. of Germany | 312/201 |

*Primary Examiner*—Victor N. Sakran
*Attorney, Agent, or Firm*—Bernard Malina

[57] ABSTRACT

Amateur photographers who print and develop their own photographs often set up a temporary darkroom in a bathroom. This invention, entitled "darkroom module" is to be placed in front of an open door of a room, such as a bathroom, to facilitate the use of the room as a darkroom by providing:

- a light seal enabling the bathroom to be light-tight
- a working area which permits the permanent mounting of photographic equipment such as an enlarger, timer, color analyzer, etc.
- storage area
- a light-proof air inlet in which a ventilating fan may be installed, if required, for adequate ventilation
- electrical outlets for photographic equipment.

When the darkroom is not required, the module is to be moved to another location. Since much of the equipment may be mounted permanently and the other equipment may be stored in the module, the setting-up time for conversion of the bathroom to a temporary darkroom is minimized.

7 Claims, 9 Drawing Figures

FIG. 5
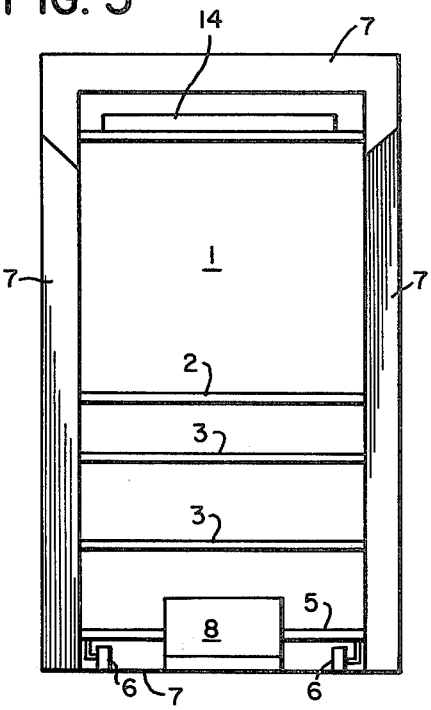
FIG. 6
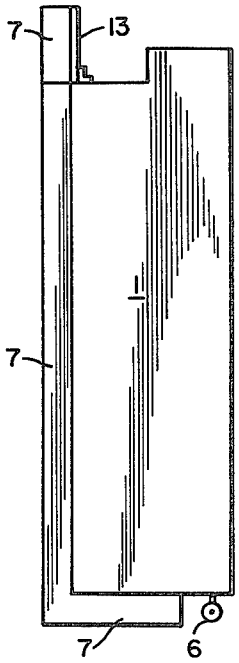
FIG. 7
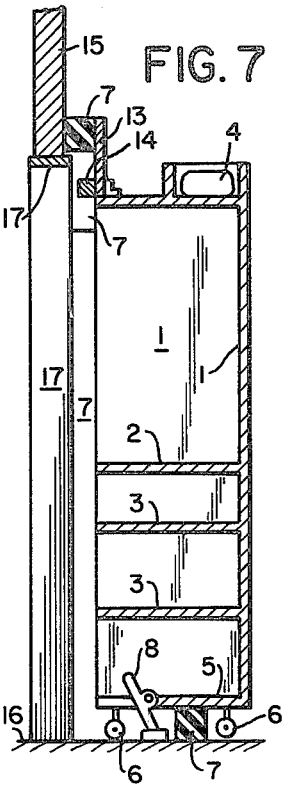
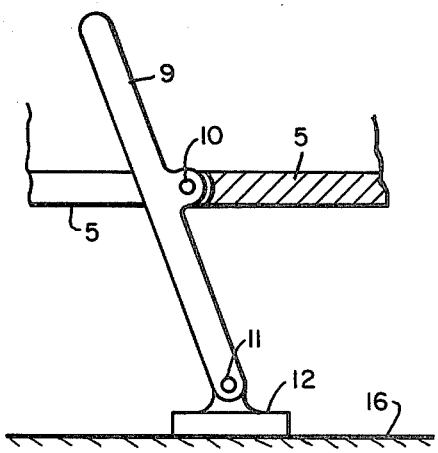
FIG. 8
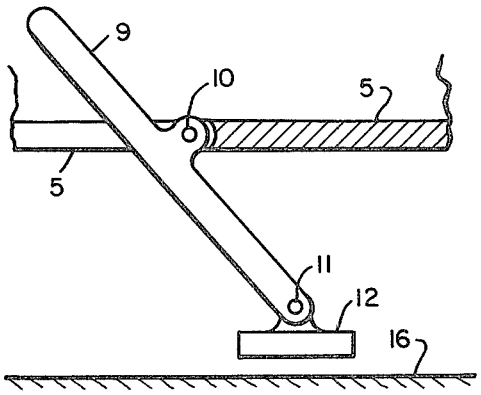
FIG. 9

DARKROOM MODULE

This invention, entitled "darkroom module" relates to an apparatus for the conversion of a bathroom, or other suitable space, into a temporary darkroom for use by amateur photographers for printing their photographs.

Amateur photographers who take their hobby seriously prefer to print their own photographs. If the photographer lives in a small home such as an apartment, the setting-up of a temporary darkroom is inconvenient because a suitable location must have a running water supply and a drain, thus limiting the choice to a bathroom or kitchen area. Further, the location chosen must be such that it can be sealed off from all light and the location should be properly ventilated. If a temporary darkroom is set up, the photographer usually wastes considerable time moving the required equipment, such as an enlarger, timer, trays, etc. to the darkroom, setting up apparatus in a suitable manner, and after completing the printing and developing, removing and storing the equipment.

The reduction of the setting-up time for equipment, the making of the darkroom area light-tight, the ensuring adequate ventilation, and the facilitating of the storing of the equipment may be accomplished by means of the "darkroom module" which is an enclosure containing some of the photograhic equipment permanently mounted in a working position, storage area for other equipment, a light seal, and a light-tight air inlet with a ventilating fan, if required, so that when the module is placed in front of an open bathroom door, the bathroom is suitable for use as a temporary darkroom. Further, the use of the module significantly increases the working area available and provides a convenient equipment storage unit when the darkroom is not required.

Figure 1:
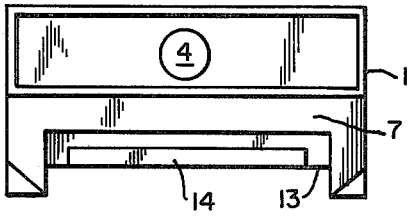
Figure 2:
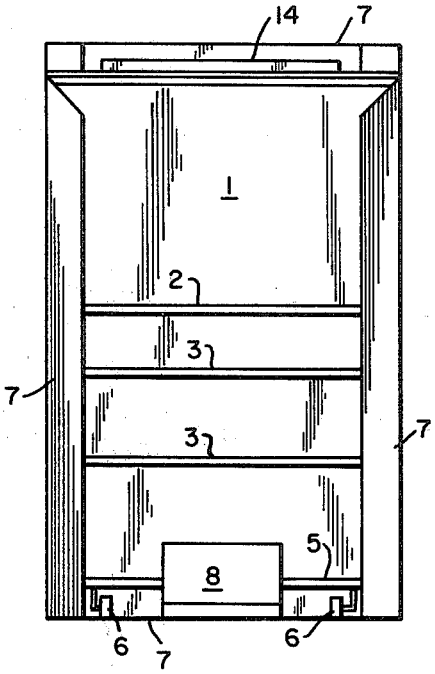
Figure 3:
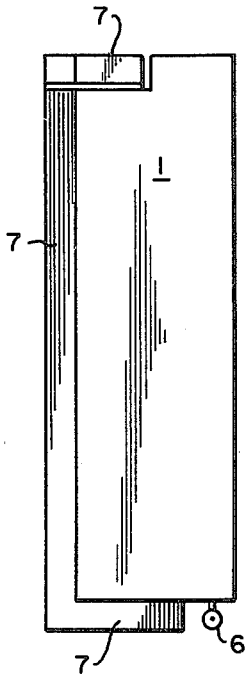
Figure 4:
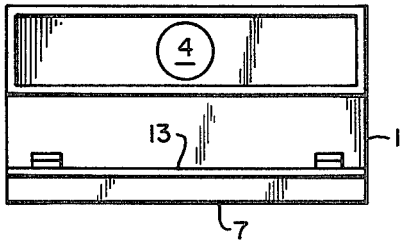

In drawings which illustrate embodiments of the invention,

FIGS. 1, 2, and 3 are orthographic top, front, and side views, respectively, of the darkroom module in a storage configuration, FIGS. 4, 5, and 6 are orthographic top, front, and side views, respectively, of the darkroom module in a working configuration, FIG. 7 shows a cross-sectional view of the module when placed against an open door, FIGS. 8 and 9 show details of the braking device in a working configuration and in a non-working configuration, respectively.

The darkroom module comprises of a cabinet 1 with one open side having light seals, casters and a braking device arranged so that when the open side is placed against an open door of a room, such as a bathroom, the room may then be used as a photographic darkroom. The cabinet has the following components and features.

A shelf 2 provides a working area on which an enlarger and other photographic equipment may be permanently mounted in a working position.

One or more storage shelves 3 provide space for photographic equipment and supplies.

One or more light-proof air inlets 4, located in the top of the cabinet 1 as shown in FIG. 7 or elsewhere in the cabinet, may be fitted with one or more ventilating fans to pressurize the darkroom and maintain adequate ventilation. If the room to be used as a darkroom has its own exhaust fan which provides adequate ventilation, the light-proof air inlet serves only to allow air into the darkroom. If the room to be used as a darkroom does not have adequate ventilation for use as a darkroom, ventilating fans installed in the light-proof air inlets will provide an adequate level of ventilation.

Electrical outlets are mounted inside the module for connecting photographic equipment such as an enlarger, timer, colour analyzer, etc. All electrical outlets are connected to a single electric wire, an extension cord, which is in turn connected by means of a two or three pronged electrical plug to a suitable electrical outlet located in or near the room to be used as the darkroom.

The base of the cabinet 5 has three or more casters 6 to enable the module to be moved between a working location and a storage location.

A light seal 7, made of a hollow rubber or plastic section, compressible from rubber or plastic, or other suitable material, enables the room to be darkened by placing the darkroom module in front of its open door. The light seal is mounted on the module so that contacts the wall 15 around a doorframe 17 on both the left-hand and right-hand sides and over the top of the doorframe 17 when the module is placed against the door and it also contacts the floor at all times. The light seal comprises of one or more pieces of opaque, soft, resilient, flexible strips of material or combination of materials which when compressed by two surfaces, one on the cabinet 1, the other on the wall 15 and the floor 16, contacts both the compressing surfaces continuously at all points. The junction of strips of a light seal may be one in which the strips contact each other or one in which the strips overlap in a side-by-side manner forming a light trap.

A braking device 8, which when lowered, permits the module to be easily pulled against the wall surrounding the open door to apply pressure to the light seal but acts to prevent motion in the opposite direction so that the light seal remains compressed and therefore light tight. The braking device, consists of at least one arm 9, two pivots, 10 and 11 and a friction plate 12, as shown in the detail drawings in FIGS. 8 and 9, or at least one arm and a friction plate integrally combined and one pivot. The arm 9 is attached to the base of the module 5 by means of a pivot 10 and to the friction plate 12 by means of a second pivot 11 or rigid construction making the arm and friction plate one piece. The distance along an arm from the pivot 10 attaching it to the base of the module, to the bottom of the friction plate 12 which contacts the floor 16, is greater than the perpendicular distance from the said pivot to the floor so that the slope of the arm from the said pivot to the friction plate is away from the open side of the module for all positions of the arm. If more than one arm is used in the braking device, all the arms must be parallel. This geometry yields a small normal force and consequently a small frictional force on the friction plate when the module is pulled towards the wall 15 surrounding the door and a large normal force and consequently a large friction force on the friction plate when the module is pushed in the opposite direction. The braking device is to be raised as shown in FIG. 9 when the module is to be moved freely. A handle with a locking device may be attached to an arm in order to facilitate the raising of the friction plate and the maintaining of the friction plate in a raised position when moving the darkroom module. The light seal is placed around the braking device so that the braking device may be lowered or raised from inside the darkroom. It is evident that if the light seal does not encompass the braking device, the latter must have its own light sealing means where its handle passes through the base of the cabinet.

The top of the module contains a hinged panel 13 on which part of the light seal 7 is mounted. When the hinged panel 13 is in a lowered horizontal position the total height of the module is reduced so that it may be moved through a doorway to a storage location. When the hinged panel 13 is in an upright vertical position the light seal will be such that it will contact a wall above a door. A vertical holding device consisting of a counterweight 14 or locking device is to be used to maintain pressure between the light seal 7 and the wall 15 when the module is in a working position.

The embodiments of the invention in which exclusive property or privilege is claimed are defined as follows:

1. A cabinet unit for use in light sealing a floor-based household dimensioned open doorway having a surrounding wall surface comprising:

a moveable housing having a top, a rear wall, a base, at least one shelf, at least one side wall joining said top to said base, and an upright open side, the front face of said top and said side wall defining the frame of said upright open side dimensioned at least slightly larger in height and width than said doorway, light sealing means of opaque soft resilient material secured to and longitudinally coextensive therewith, and also secured to said base and depending downward therefrom toward said floor, means for releasably urging said upright frame toward said surrounding wall surface thereby to compress said light sealing means between said frame and said wall surface and for releasably moving said housing base toward said floor to thereby compress said light sealing means between said base and said floor to thereby light seal the interior of said cabinet unit, a hinged panel containing a portion of said light sealing means hingedly mounted to said housing top at the edge of said open side whereby said hinged panel is free to rotate between a horizontal position and a vertical position, and holding means for maintaining said hinged panel in said vertical position.

2. A cabinet unit as defined in claim 1 which is supported on at least three casters secured to said base.

3. A cabinet unit as defined in claim 1 including lightproof ventilating means.

4. A cabinet unit as defined in claim 1 including multiple electrical outlets connected to an electrical extension cord adaptable for connection to an existing electrical outlet.

5. A cabinet unit as defined in claim 1 wherein said urging means comprises braking means operative to firmly maintain said open side against said open doorway to thereby maintain said light sealing means in compression.

6. A cabinet unit as defined in claim 5 wherein said braking means comprises a friction plate, at least one arm pivotally connected at its upper end to said housing base and pivotally connected at its lower end to said friction plate whereby the slope of said arm for all positions thereof is directed away from said open side of said housing, and a means for raising and lowering and maintaining said friction plate in a raised position.

7. A cabinet unit as defined in claim 5 wherein said braking means comprises a friction plate rigidly attached to at least one arm pivotally connected at its upper end to said cabinet unit base whereby the slope of said arm for all positions thereof is directed away from said open side of said cabinet unit and a means for raising lowering and maintaining said friction plate in a raised position.

* * * * *